US008365337B2

(12) United States Patent
Tash

(10) Patent No.: US 8,365,337 B2
(45) Date of Patent: Feb. 5, 2013

(54) HAND-OPERATED DRAIN SNAKE WITH AUGER

(75) Inventor: George Tash, Somis, CA (US)

(73) Assignee: George Tash and Debra B. Tash, As Trustees of the Community Trust, Somis, CA (US)

( * ) Notice: Subject to any disclaimer, the term of this patent is extended or adjusted under 35 U.S.C. 154(b) by 334 days.

(21) Appl. No.: 12/833,351

(22) Filed: Jul. 9, 2010

(65) Prior Publication Data

US 2012/0005849 A1 Jan. 12, 2012

(51) Int. Cl.
*B08B 1/00* (2006.01)

(52) U.S. Cl. ..... 15/104.33; 15/104.03; 15/104.05; 15/104.001

(58) Field of Classification Search ..... 15/104.03, 15/104.05, 104.001, 104.31, 104.33
See application file for complete search history.

(56) References Cited

U.S. PATENT DOCUMENTS

| | | | | |
|---|---|---|---|---|
| 584,508 | A | 6/1897 | Hughes | |
| 619,920 | A * | 2/1899 | Wrigley | 15/104.33 |
| 834,135 | A | 10/1906 | Hymes | |
| 3,124,821 | A * | 3/1964 | Mathews | 15/104.16 |
| 5,769,960 | A | 6/1998 | Nirmel | |
| D435,944 | S | 1/2001 | Luoma | |
| 6,775,873 | B2 * | 8/2004 | Luoma | 15/104.33 |
| D511,278 | S | 11/2005 | Carfagnini | |
| D518,252 | S | 3/2006 | Wu | |
| 7,584,513 | B2 | 9/2009 | Turner | |
| 2007/0143912 | A1 | 6/2007 | Thorp et al. | |

FOREIGN PATENT DOCUMENTS

| | | | |
|---|---|---|---|
| EP | 1647637 | B1 | 12/2007 |
| GB | 2196089 | A | 4/1988 |

* cited by examiner

*Primary Examiner* — William Gilbert
*Assistant Examiner* — Patrick Maestri
(74) *Attorney, Agent, or Firm* — Lyon & Harr, LLP; Richard T. Lyon

(57) ABSTRACT

A hand-operated drain snake is provided. The snake includes a first shaft having a first longitudinal axis, an auger disposed on an exterior surface of the first shaft, a second shaft having a second longitudinal axis, and a transverse member. A proximal end of the first shaft is disposed on one side of the transverse member and a proximal end of the second shaft is disposed on an opposite side of the transverse member such that the first axis is substantially parallel to the second axis, and the first axis is offset from the second axis by an offset distance.

21 Claims, 6 Drawing Sheets

HAND-OPERATED DRAIN SNAKE WITH AUGER

BACKGROUND

A drain system provides an infrastructure to route waste fluid such as water and the like which accumulates in a water container to a public sewer system. Exemplary water containers include sinks, bathtubs, showers and the like. A typical drain system is configured as follows. A drain opening is located at the bottom of the water container. The drain opening may optionally include a drain-stopper which can be selectively lowered using a mechanism to close the drain opening and prevent the waste fluid from flowing through the drain opening. A drainpipe is located under the drain opening and is sealably attached to the bottom thereof. The drainpipe commonly includes a water trap. Drain systems can become clogged with one or more foreign materials which accumulate over time in remote areas of the drain systems such as the drain-stopper mechanism and the water trap. Until the clog is removed, drainage of the waste fluid out of the water container can be greatly slowed down or stopped completely so that the waste fluid is left standing in the water container. Thus, removing clogs from drain systems which have become clogged is a necessity of life.

SUMMARY

This Summary is provided to introduce a selection of concepts, in a simplified form, that are further described hereafter in the Detailed Description. This Summary is not intended to identify key features or essential features of the claimed subject matter, nor is it intended to be used as an aid in determining the scope of the claimed subject matter.

Drain snake embodiments described herein generally involve a hand-operated drain snake. In an exemplary embodiment the snake includes a first shaft having a first longitudinal axis, an auger disposed on an exterior surface of the first shaft, a second shaft having a second longitudinal axis, and a transverse member. A proximal end of the first shaft is disposed on one side of the transverse member and a proximal end of the second shaft is disposed on an opposite side of the transverse member such that the first axis is substantially parallel to the second axis, and the first axis is offset from the second axis by an offset distance.

DESCRIPTION OF THE DRAWINGS

The specific features, aspects, and advantages of the drain snake embodiments described herein will become better understood with regard to the following description, appended claims, and accompanying drawings where:

DETAILED DESCRIPTION

In the following description of drain snake embodiments reference is made to the accompanying drawings which form a part hereof, and in which are shown, by way of illustration, specific embodiments in which the drain snake can be practiced. It is understood that other embodiments can be utilized and structural changes can be made without departing from the scope of the drain snake embodiments.

The term "water trap" is used herein to refer to a P-shaped, S-shaped, U-shaped, or J-shaped (among others) segment of a drainpipe. As is appreciated in the art of plumbing fixtures, after a waste fluid flows into a drain opening, through the drainpipe and into a sewer system, the trap retains a small amount of the fluid. This retained fluid in the trap creates a seal that generally serves to prevent gases in the sewer system from passing through the drainpipe and exiting the drain opening into the room in which the drain opening is located.

1.0 Hand-Operated Drain Snake with Auger

Generally speaking, the drain snake embodiments described herein are applicable to unclogging a drain system which has become clogged. In other words, the drain snake embodiments can be used to remove obstructions which develop in a drain system and restore effective draining of a waste fluid through the drain system.

The drain snake embodiments described herein are advantageous for a variety of reasons including, but not limited to, the following. The drain snake embodiments can be effectively used to unclog a variety of different types of drain systems in a convenient, rapid and environmentally friendly manner, even in situations where the clog is located in a remote area of the drain system such as the aforementioned drain-stopper mechanism, water trap, and the like. The drain snake embodiments obviate the need to use caustic chemical or biological substances to unclog the drain system. The drain snake embodiments also obviate the need to remove any drain-stopper which may exist in the drain system, or disassemble the drain system in any other way to unclog it.

Additionally, as will become apparent from the more detailed description that follows, the drain snake embodiments described herein are safe and easy to use, are durable, and can be reused over and over again without damaging the drain system. Therefore, besides being used to unclog a drain system which has become clogged, the drain snake embodiments facilitate routine maintenance of the drain system to periodically remove any foreign materials which have accumulated on inside surfaces of the drain system. The drain snake embodiments are also compact in size, thus making them easy to store and transport. The drain snake embodiments can also be economically manufactured, thus making them inexpensive to purchase.

1.1 Drain System

Figure 1:
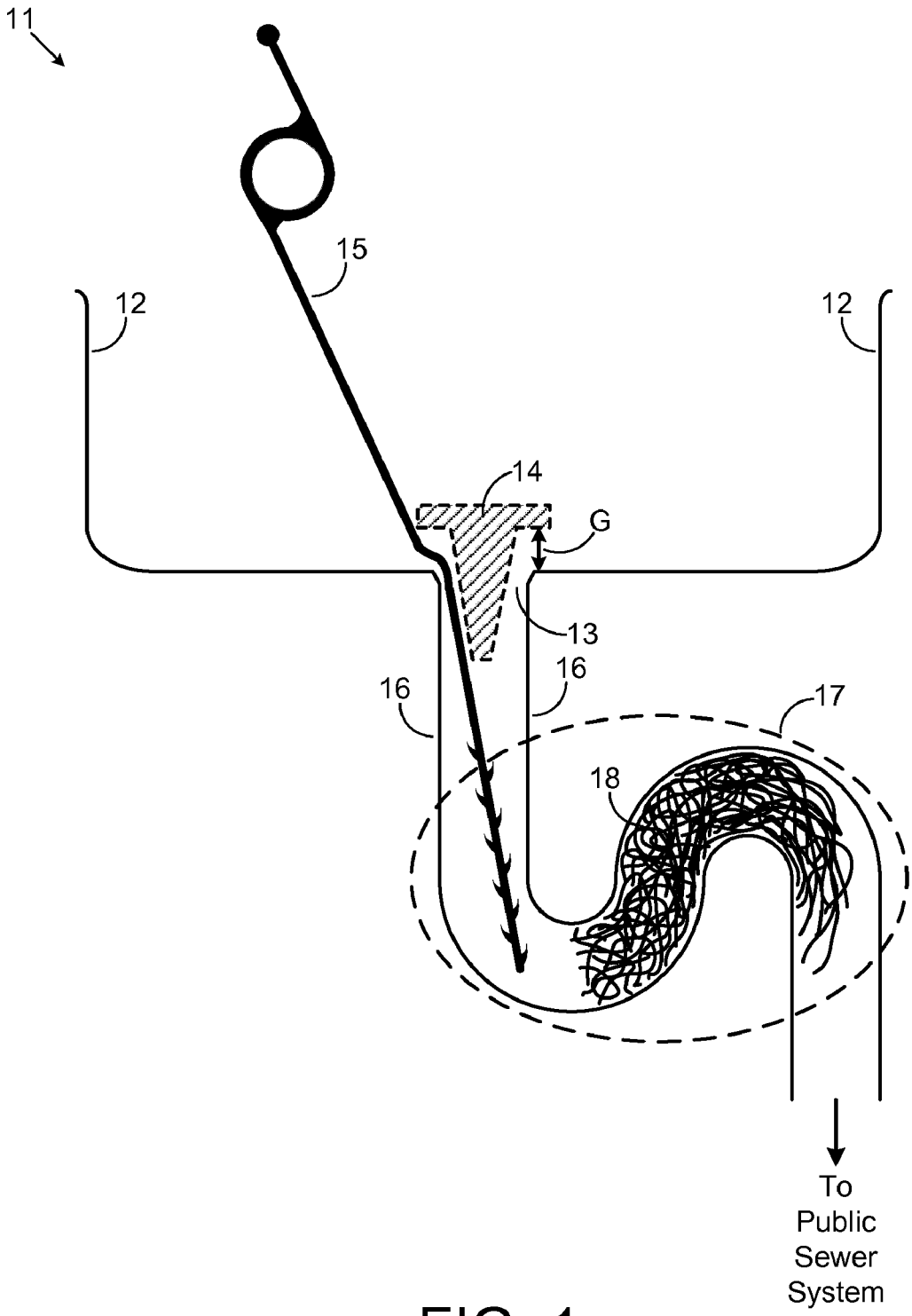
FIG. 1 is a diagram illustrating a longitudinal cross-sectional view, in simplified form, of an exemplary embodiment of a drain system which constitutes an exemplary environment for utilizing the drain snake embodiments.

FIG. 1 illustrates a longitudinal cross-sectional view, in simplified form, of an exemplary embodiment of a drain system which constitutes an exemplary environment for utilizing the drain snake embodiments described herein. As exemplified in FIG. 1, the drain system 11 includes a water container 12 which collects a waste fluid (not shown) such as water and the like. As described heretofore, exemplary water containers include, but are not limited to, sinks, bathtubs and showers. A drain opening 13 is located at the bottom of the water container 12. A drainpipe 16 is located under the drain opening 13. One end of the drainpipe 16 is sealably attached to the bottom of the drain opening 13 and the other end of the drainpipe is sealably attached to a public sewer system. As described heretofore, the drainpipe 16 commonly includes a water trap 17 which can have a variety of shapes including, but not limited to, a P-shape, an S-shape, a U-shape, or a J-shape (among others). An S-shaped water trap 17 is exemplified in FIG. 1. It is noted that the drain snake embodiments can also be used to unclog the drain system associated with a urinal.

Referring again to FIG. 1, the drain opening 13 may optionally include a drain-stopper 14 which can be selectively raised to an open position (as shown in FIG. 1) using a mechanism (not shown), or lowered to a closed position (not shown) using the mechanism. The drain-stopper 14 is normally left in the open position which leaves an annular peripheral drainage gap G between the drain-stopper and the drain opening 13, where this gap G typically has a height of between ¼ inch and ½ inch. This gap G allows the waste fluid to freely flow downward through the drain opening 13 and the drainpipe 16 which is attached thereto. As will be described in more detail hereafter, a drain snake 15 can be inserted into the drainpipe 16 via the gap G.

Generally speaking and referring again to FIG. 1, a clog 18 can develop in the drain system 11 as it is used over time, where the clog is composed of one or more foreign materials which are present in the waste fluid that flows into the drain opening 13, through the drainpipe 16 and into the sewer system. More particularly, strands and/or clumps of hair (such as human hair, animal hair and the like) and other fibrous material can be present in the waste fluid that flows through the drain opening and the drainpipe. This hair and other fibrous material can attach itself to various inside surfaces of the drain system such as the mechanism used to raise and lower the drain-stopper 14, the water trap 17, and the like. Over time additional hairs and fibrous material can become entangled, and can start matting and collecting other materials that may be present within the waste fluid such as skin cells, soap scum, body oils, oils and greases from personal care products, other organic material, dirt and other debris. As time goes on this entangled, matted collection of materials can grow and expand to the point where a clog is formed that completely or nearly completely obstructs the drainpipe. FIG. 1 exemplifies such a clog in the water trap of the drainpipe.

1.2 Drain Snake Design

Figure 2:
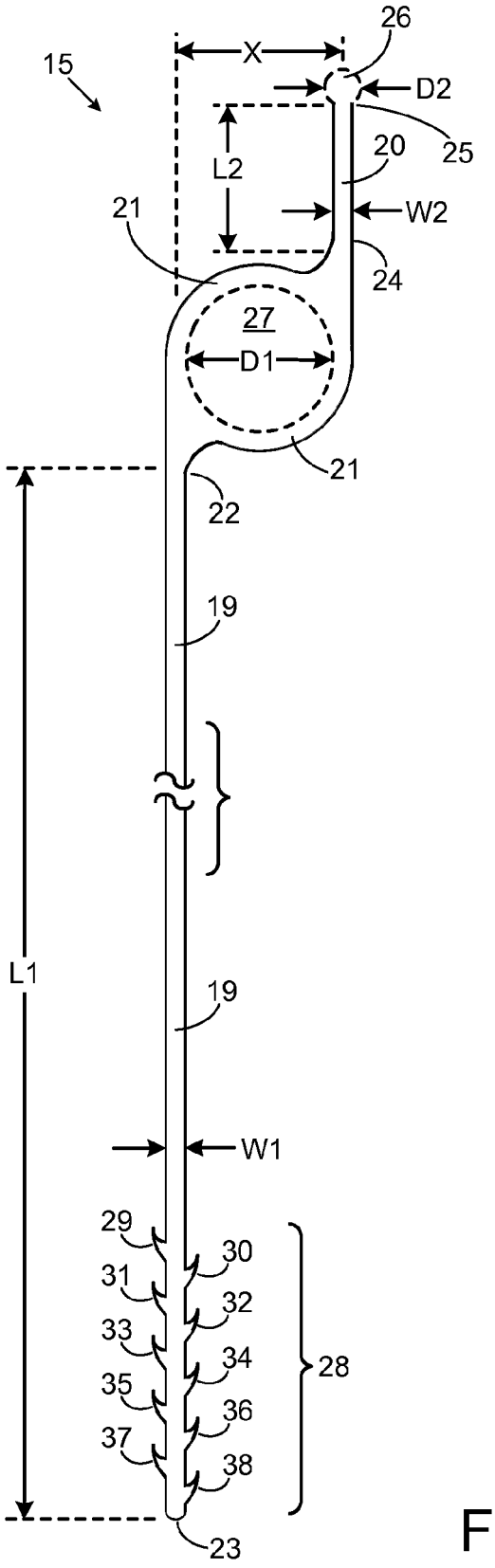
FIG. 2 is a diagram illustrating a longitudinal plan view of one embodiment of a drain snake having one embodiment of an auger.

FIG. 2 illustrates a longitudinal plan view of one embodiment of the drain snake having one embodiment of an auger. As exemplified in FIG. 2, the drain snake 15 includes a first shaft 19, a second shaft 20 (which is hereafter also referred to as a "cranking apparatus") and a transverse member 21 (which is hereafter also referred to as an "interconnecting apparatus"). The transverse member 21 serves to rigidly attach the first shaft 19 to the second shaft 20 as follows. The proximal end of the first shaft 22 is rigidly disposed on one side of the transverse member 21 and the proximal end of the second shaft 24 is rigidly disposed on an opposite side of the transverse member such that the longitudinal axis of the first shaft is substantially parallel to the longitudinal axis of the second shaft, and the longitudinal axis of the first shaft is offset from the longitudinal axis of the second shaft by a prescribed offset distance X. In one embodiment of the drain snake described herein the offset distance X has a value of one inch. Alternate embodiments of the drain snake are also possible where the offset distance X can have a value that is either less than one inch or greater than one inch.

Referring again to FIG. 2, an auger 28 is rigidly disposed on the exterior surface of the first shaft 19. Various embodiments of the auger 28 are possible. These auger 28 embodiments will be described in more detail hereafter. The auger 28 can be located in various positions along the longitudinal axis of the first shaft. By way of example but not limitation, in the drain snake embodiment exemplified in FIG. 2 the distal end of the auger is located adjacent to the distal end of the first shaft 23.

Referring again to FIGS. 1 and 2, the combination of the first shaft 19 and the auger 28 is hereafter referred to as an "augering apparatus." As will be appreciated from the more detailed description of the various auger embodiments provided hereafter, the augering apparatus serves various purposes (i.e., the augering apparatus is multi-functional). By way of example but not limitation, the augering apparatus serves to dislodge any foreign materials that are deposited on the surface of the drain-stopper 14 (if one is included in the drain opening 13) and the interior wall of the drainpipe 16 as the drain snake 15 is forcibly pushed through the drainpipe. In other words, the augering apparatus serves as a scraping device. The augering apparatus also serves to bore through the clog 18 as the drain snake is forcibly rotated through the clog (i.e., the augering apparatus also serves as a boring device). The augering apparatus also serves to snag and entangle the foreign materials that make up the clog, and progressively wind these materials onto the augering apparatus as the drain snake is forcibly rotated through the clog. In other words, the augering apparatus also serves as a pick-up device. The augering apparatus also serves to drag these materials out of the drain system 11 as the drain snake is forcibly withdrawn from the drainpipe and drain opening (i.e., the augering apparatus also serves as a clog-removal device).

Referring again to FIG. 2, the first shaft 19 has a prescribed length L1 and the second shaft 20 has a prescribed length L2. Generally speaking, length L1 and length L2 can have a variety of values, and these values are independently set according to the needs of one or more types of water containers and their associated drain systems that the drain snake 15 is intended to be used on. The following considerations exist when selecting the particular values that are used for lengths L1 and L2. The first shaft should be long enough to allow its distal end 23 to travel all the way through the aforementioned water trap when the drain snake is inserted into the aforementioned drainpipe of a drain system. Likewise, the second shaft should be long enough to allow an individual to effectively grasp and rotate the second shaft as will be described in more detail hereafter. However, the longer the first and second shafts are, the more difficult it is to maneuver and store the drain snake. Thus, it is advantageous to limit the lengths L1 and L2 so as not to be any larger than is necessary for the drain snake to operate effectively in the one or more different types of drain systems it is to be used on.

As exemplified in FIG. 2, length L1 will typically be much greater than length L2 when the drain snake is intended to be used on drain systems associated with sinks, bathtubs, showers, urinals and the like. More particularly, in one embodiment of the drain snake described herein length L1 has a value of 22 inches and length L2 has a value of one inch. This particular value for L1 allows the distal end of the first shaft travel completely through the water trap when the drain snake is inserted into the drainpipe of a typical sink, bathtub, shower, urinal and the like. The aforementioned value for L2 allows an individual to effectively grasp and rotate the second shaft with their thumb and another finger such as their index finger and the like. It is noted however that alternate embodiments of the drain snake are also possible where any other values are employed for length L1 and length L2, and where either length L1 is equal to length L2, or length L1 is less than length L2. It will be appreciated that by altering the values for lengths L1 and L2 the drain snake can be made suitable for use in virtually any kind of drain system.

Referring again to FIG. 2, the first shaft 19 has a prescribed width W1 and the second shaft 20 has a prescribed width W2. Generally speaking, width W1 and width W2 can have a variety of values, and these values are independently set according to the needs of one or more types of water containers and their associated drain systems that the drain snake 15 is intended to be used on. The following considerations exist when selecting the particular values that are used for widths W1 and W2. The width W1 of the first shaft should be small enough to allow the first shaft to slide freely through the aforementioned annular peripheral drainage gap G between the aforementioned drain-stopper and the aforementioned drain opening, and allow the distal end of the first shaft to travel through the drainpipe to the location of the clog. Likewise, the width W2 of the second shaft should be appropriately sized to allow an individual to effectively grasp and rotate the second shaft as will be described in more detail hereafter. However, if the widths of the first and second shafts are too small, the structural integrity of the first and second shafts can be compromised and the shafts could break while the drain snake is being inserted into and rotated in the drainpipe.

As exemplified in FIG. 2, width W1 will typically be equal to width W2 when the drain snake is intended to be used on drain systems associated with sinks, bathtubs, showers, urinals and the like. More particularly, in one embodiment of the drain snake described herein widths W1 and W2 have a value of four millimeters. This particular value for W1 allows the first shaft to slide freely through the gap G between the drain-stopper and the drain opening of a typical sink, bathtub, shower and the like, and allows the distal end of the first shaft to travel through the drainpipe to the location of the clog, while providing the first shaft with sufficient structural integrity to avoid breakage. This particular value for W2 allows an individual to effectively grasp and rotate the second shaft, while providing the second shaft with sufficient structural integrity to avoid breakage. It is noted however that alternate embodiments of the drain snake are also possible where any other values are employed for width W1 and width W2, and where either width W1 is greater than width W2, or width W1 is less than width W2. It will be appreciated that by altering the values for widths W1 and W2 the drain snake can be made suitable for use in virtually any kind of drain system.

Figure 9A:
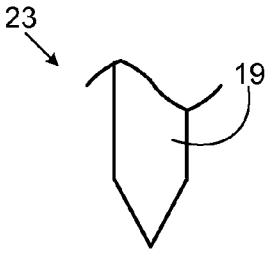
FIGS. 9A-9C are diagrams illustrating close-up, longitudinal plan views of alternate embodiments of a distal end of the drain snake.
Figure 9B:
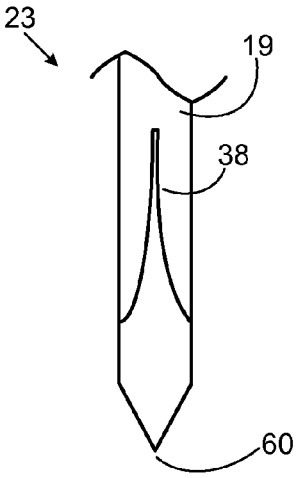
Figure 9C:
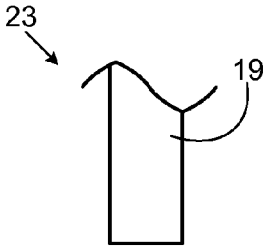

As exemplified in FIG. 2, in one embodiment of the drain snake described herein the distal end 23 of the first shaft 19 has a rounded, semi-spherical shape. Alternate embodiments of the drain snake are also possible where the distal end of the first shaft can have any other shape. By way of example, but not limitation, FIGS. 9A-9C illustrate close-up, longitudinal plan views of some of these alternate embodiments of the distal end 23 of the first shaft 19. As exemplified in FIG. 9A, the distal end of the first shaft can have a conical shape. As exemplified in FIG. 9B, the distal end of the first shaft can also have a wedge shape, where the linear edge 60 formed by the two faces of this wedge shape can have any radial orientation. As exemplified in FIG. 9C, the distal end of the first shaft can also be planar.

Referring again to FIG. 2, the transverse member 21 serves as a handle by which an individual can grasp and maneuver the drain snake 15. The transverse member can have various exterior shapes. In the embodiment of the drain snake exemplified in FIG. 2, the transverse member has a circular exterior shape. Alternate embodiments of the drain snake (not shown) are also possible where the transverse member can have any other exterior shape, including but not limited to an oval exterior shape, a square exterior shape, a rectangular exterior shape, an hexagonal exterior shape, and the like. The transverse member can be rigidly disposed on the proximal end of the first shaft 22 in various ways. By way of example, but not limitation, in one embodiment of the drain snake described herein the transverse member can be integrally formed with the proximal end of the first shaft as exemplified in FIG. 2. In another embodiment of the drain snake (not shown) the proximal end of the first shaft can be threaded, and can be screwed into a similarly threaded first receptacle on the transverse member. Similarly, the transverse member can be rigidly disposed on the proximal end of the second shaft 24 in various ways. By way of example, but not limitation, in one embodiment of the drain snake, the transverse member can be integrally formed with the proximal end of the second shaft as exemplified in FIG. 2. In another embodiment of the drain snake (not shown) the proximal end of the second shaft can be threaded, and can be screwed into a similarly threaded second receptacle on the transverse member. It is noted that the proximal end of the first shaft can be rigidly disposed on the transverse member in one way, and the proximal end of the second shaft can be rigidly disposed on the transverse member in a different way. Alternately, the proximal end of the first shaft and proximal end of the second shaft can be rigidly disposed on the transverse member in the same way.

Referring again to FIG. 2, the transverse member 21 can optionally include an interior opening 27 which can have various interior shapes. The interior shape of the interior opening 27 can either be the same shape as the exterior shape of the transverse member 21, or the interior shape of the interior opening can be different than the exterior shape of the transverse member. In the embodiment of the drain snake exemplified in FIG. 2, the interior shape of the interior opening 27 and the exterior shape of the transverse member 21 are both circular. Alternate embodiments of the drain snake (not shown) are also possible where the interior opening 27 can have any other interior shape, including but not limited to an oval interior shape, a square interior shape, a rectangular interior shape, an hexagonal interior shape, and the like. The interior opening 27 has a prescribed diameter D1 which can have a variety of values. In the aforementioned embodiment of the drain snake where the offset distance X has a value of one inch, the diameter D1 can have a value of 13/16 of an inch, which allows a typical finger to be inserted into the interior opening. Alternate embodiments of the drain snake are also possible where the diameter D1 can have a value of either greater than 13/16 of an inch, or less than 13/16 of an inch. The interior opening 27 is advantageous for a variety of reasons including, but not limited to, the following. The interior opening 27 enhances the storability of the drain snake 15 by permitting the snake to be hung on a vertical surface via a hook, and the like. The interior opening 27 also enhances an individual's ability to grasp the drain snake and maneuver it as needed to unclog a drain system which has become clogged with one or more foreign materials as described heretofore. It is noted that in the drain snake embodiment where the transverse member does not have an interior opening, the transverse member has a solid interior.

Referring again to FIG. 2, a finger retention member 26 can be optionally rigidly disposed on the distal end of the second shaft 25. The finger retention member 26 has a prescribed diameter D2 which is greater than the width W2 of the second shaft 20. As such, the finger retention member serves to keep an individual's fingers from sliding off of the second shaft when they rotate the second shaft in the manner which is described in more detail herein. In the aforementioned drain snake embodiment where width W2 has a value of four millimeters, diameter D2 can have a value of seven millimeters. It is noted that alternate embodiments of the drain snake described herein are also possible where width W2 can have any other value. Generally speaking, the finger retention member 26 can have a variety of exterior shapes. In the embodiment of the drain snake exemplified in FIG. 2, the finger retention member 26 has a spherical exterior shape. Alternate embodiments of the drain snake are also possible where the finger retention member 26 can have any other exterior shape such as a pentagonal icositetrahedron exterior shape, a pentagonal hexecontahedron exterior shape, and the like.

Generally speaking and referring again to FIG. 2, in one embodiment of the drain snake described herein the first shaft 19 has a radial cross-sectional shape that is circular. Additional embodiments of the drain snake are also possible where the first shaft can have any other radial cross-sectional shape. Thus, the first shaft can have a radial cross-sectional shape that is oval, square, rectangular, hexagonal, or octagonal, among others. Similarly, in one embodiment of the drain snake the second shaft 20 has a radial cross-sectional shape that is circular. Additional embodiments of the drain snake are also possible where the second shaft can have any other radial cross-sectional shape. Thus, the second shaft can have a radial cross-sectional shape that is oval, square, rectangular, hexagonal, or octagonal, among others. Furthermore, in one embodiment of the drain snake the first shaft and second shaft have the same radial cross-sectional shape. Another embodiment of the drain snake is also possible where the first shaft and second shaft can have different radial cross-sectional shapes. By way of example but not limitation, the first shaft can have a radial cross-sectional shape that is square and the second shaft can have a radial cross-sectional shape that is circular.

Referring again to FIG. 2, the first shaft and second shaft can have an axial interior that is either solid or hollow. Having a hollow axial interior for the first and second shafts can be advantageous in that it minimizes the amount of material used to construct the drain snake. Having a hollow axial interior for the first shaft can also enhance the flexibility of the first shaft along its longitudinal axis. However, it is noted that having a hollow axial interior for the first and second shafts can also compromise their structural integrity depending on the type of material they are constructed from.

Generally speaking and referring again to FIGS. 1 and 2, the drain snake 15 can be constructed either from any homogeneous material that is durable and resiliently flexible, or from any heterogeneous combination of different materials where the combination is durable and resiliently flexible. The durable nature of the material(s) allows the following operations to be performed repeatedly as necessary without the drain snake being damaged. The drain snake can be forcibly pushed into the drainpipe 16 and its water trap 17 via the drainage gap G between the drain-stopper 14 and the drain opening 13. The drain snake can then be forcibly rotated within the drain opening, drainpipe and water trap. The drain snake can then be forcibly withdrawn therefrom. The resiliently flexible nature of the material(s) allows the first shaft 19 of the drain snake to bend and deform along its longitudinal axis as necessary to accomplish these operations, and to follow the curvature of the interior of the drainpipe and water trap. The resiliently flexible nature of the material(s) further allows the auger 28 to be rotated through the clog 18. The resiliently flexible nature of the material(s) yet further allows the first shaft to generally return to its original shape when the drain snake is withdrawn and the bending/deforming forces are removed.

Referring again to FIGS. 1 and 2, in one set of drain snake embodiments described herein the drain snake 15 can be constructed from a homogeneous material such as a synthetic resin, an elastomer, and the like. It is noted that materials such as synthetic resin and an elastomer are advantageous since they are resistant to corrosion and they minimize friction between the drain snake and the drain-stopper 14, the drainpipe 16, and its water trap 17. The resin or elastomer can optionally include one or more antibacterial agents which serve to kill any bacteria that come in contact with the drain snake. In another set of drain snake embodiments the drain snake can be constructed from two different materials, where an outer layer of a first material is disposed over an inner core of a second material. By way of example but not limitation, the drain snake can be constructed from an elastomeric core over which a thin polytetrafluoroethylene (PTFE) layer is disposed. This particular embodiment is advantageous in that it minimizes the usage of the more expensive PTFE material (as compared to the elastomeric core).

1.2.1 Barb-Based Auger

Figure 3:
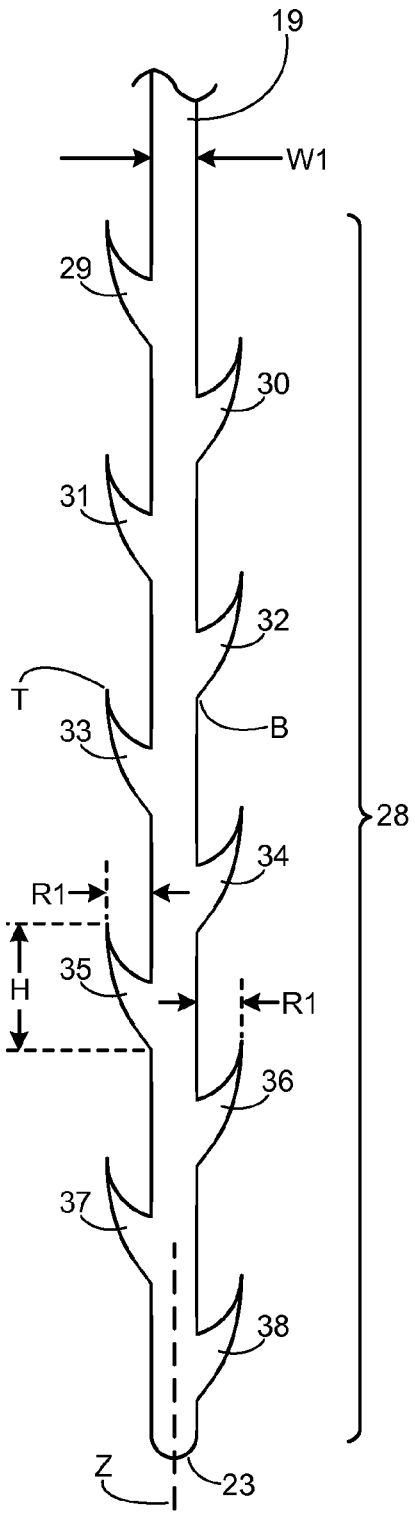
FIG. 3 is a diagram illustrating a close-up, longitudinal plan view of the auger of the drain snake of FIG. 2.
Figure 4:
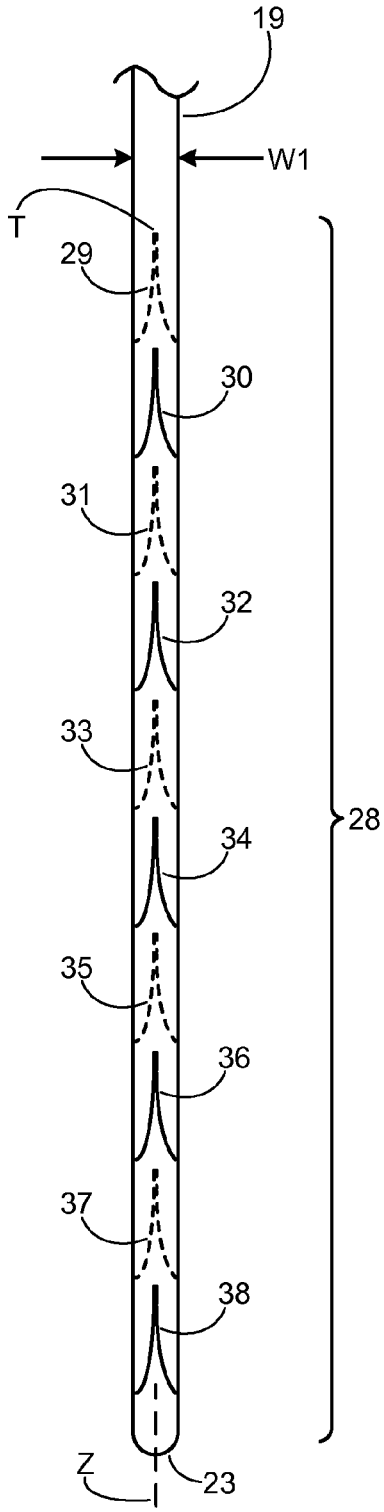
FIG. 4 is a diagram illustrating a transparent plan view of the auger of FIG. 3 rotated counter-clockwise 90 degrees about its longitudinal axis.

FIGS. 3 and 4 illustrate close-up views of one embodiment of the aforementioned auger. More particularly, FIG. 3 illustrates a close-up, longitudinal plan view of the auger of the drain snake of FIG. 2. FIG. 4 illustrates a transparent plan view of the auger of FIG. 3 rotated counter-clockwise 90 degrees about its longitudinal axis. Generally speaking, as exemplified in FIGS. 3 and 4 and referring again to FIG. 2, the auger 28 includes a plurality of barbs 29-38 which are rigidly disposed on the exterior surface of the first shaft 19 such that each barb extends radially outward from the first shaft. The barbs 29-38 are substantially rigid and thus are substantially non-pliable. Each barb 29-38 is shaped in the general form of a hook which tapers radially outward from the first shaft 19 and longitudinally upward to a pointed tip T which points toward the proximal end of the first shaft 22. The barbs 29-38 are sequentially arranged along the first shaft 19, starting at the distal end of the first shaft 23, such that the barbs are radially oriented along a common plane that is centered along the longitudinal axis Z of the first shaft. In the drain snake embodiment exemplified in FIGS. 3 and 4 the auger includes ten barbs, where successive barbs in the sequential arrangement (such as barbs 32 and 33, and the like) are rigidly disposed on radially opposite sides of the first shaft 19 (i.e., successive barbs in the sequential arrangement are radially oriented 180 degrees from each other). In another drain snake embodiment (not shown) the auger includes eleven barbs where successive barbs in the sequential arrangement are rigidly disposed on radially opposite sides of the first shaft. Alternate drain snake embodiments (not shown) are also possible where the number of barbs is either less than ten or greater than eleven. Alternate drain snake embodiments (not shown) are also possible where successive barbs in the sequential arrangement are rigidly disposed on a common radial side of the first shaft. Alternate drain snake embodiments (not shown) are also possible where different subsets of barbs (each subset including one or more barbs) are radially oriented along two or more different planes.

Referring again to FIGS. 1 and 3, each barb 29-38 has a prescribed longitudinal height H and each barb extends a prescribed radial distance R1 from the exterior surface of the first shaft 19. Generally speaking, height H and distance R1 can have a variety of values, and these values are independently set according to the needs of one or more types of water containers 12 and their associated drain systems that the drain snake 15 is intended to be used on. The following considerations exist when selecting the particular values that are used for height H and distance R1. Distance R1 is generally set to a value which is as large as possible while still allowing the auger 28 to slide freely through the annular peripheral drainage gap G between the drain-stopper 14 and the drain opening 13, and also still allowing the auger to travel through the drainpipe 16 to the location of the clog 18. Setting distance R1 to an overly small value can reduce each barb's effectiveness as a scraping device, a boring device, a pick-up device and a clog-removal device. Height H is generally set to a value which is large enough to maintain each barb's effectiveness as a scraping device, a boring device, a pick-up device and a clog-removal device, while still allowing a reasonable number of barbs to be included in the auger. Setting height H to an overly small value can reduce each barb's effectiveness. On the other hand, setting height H to an overly large value can reduce the number of barbs in the auger and can also reduce the flexibility of the auger along the longitudinal axis Z. In the aforementioned exemplary embodiment of the drain snake where the first shaft 19 has a width W1 of four millimeters, height H can have a value of seven millimeters and distance R1 can have a value of three millimeters.

Generally speaking, the longitudinal spacing between successive barbs in the sequential arrangement of barbs can be varied to create different drain snake embodiments. In the drain snake embodiment exemplified in FIGS. 2-4, this longitudinal spacing is set such that the pointed tip T of each barb in the sequential arrangement (such as barb 33) is aligned along the longitudinal axis Z with the bottom B of the next barb in the arrangement (such as barb 32). In another drain snake embodiment (not shown) successive barbs in the sequential arrangement can be overlapped along the longitudinal axis Z such that the pointed tip T of each barb in the arrangement longitudinally overlaps the next barb in the arrangement. In yet another alternate drain snake embodiment (not shown) the pointed tip T of each barb in the sequential arrangement can be separated along the longitudinal axis Z from the bottom B of the next barb in the arrangement by a prescribed distance.

Generally speaking and referring again to FIG. 2, the barbs 29-38 can be constructed from the same material(s) as the rest of the drain snake 15. More particularly, in the aforementioned drain snake embodiment where the drain snake is constructed from a homogeneous material, the barbs can be constructed from this same homogeneous material. In the aforementioned drain snake embodiment where the drain snake is constructed from an outer layer of a first material that is disposed over an inner core of a second material, the barbs can be constructed in a similar manner.

1.2.2 Helical Fin-Based Auger

Figure 5:
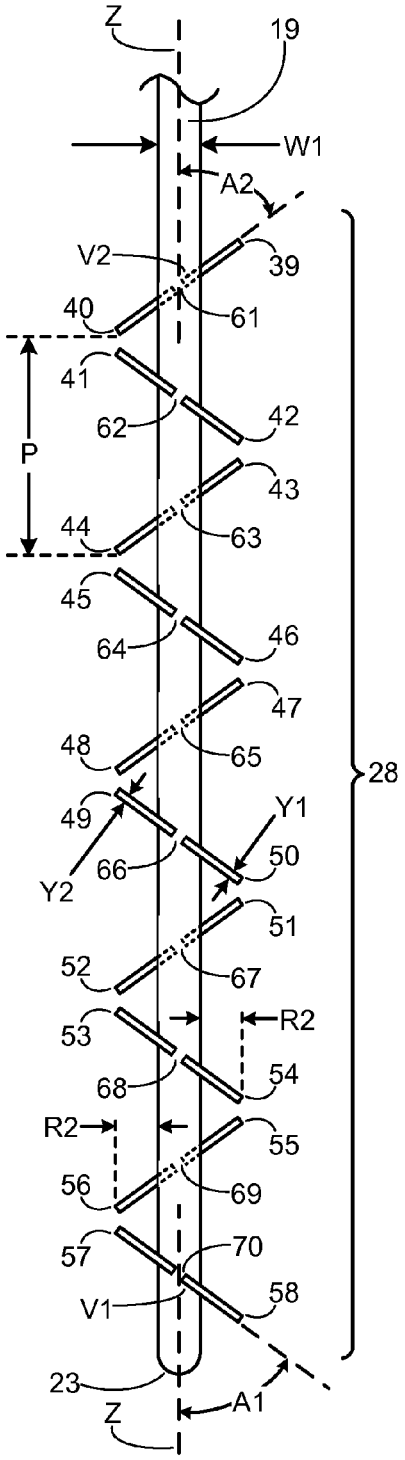
FIG. 5 is a diagram illustrating a close-up, longitudinal, transparent plan view of an alternate embodiment of the auger.
Figure 6:
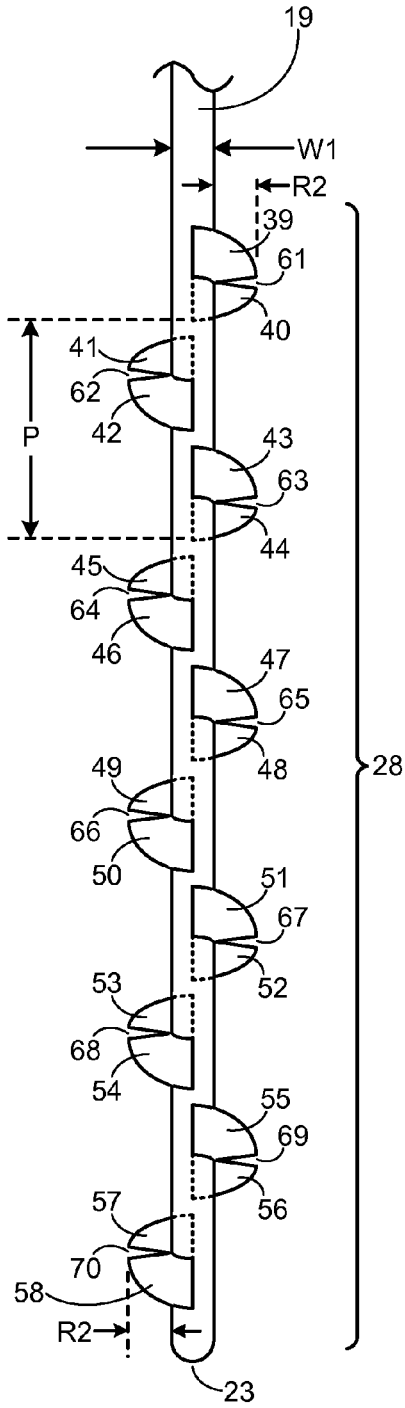
FIG. 6 is a diagram illustrating a transparent plan view of the auger of FIG. 5 rotated counter-clockwise 90 degrees about its longitudinal axis.
Figure 7:
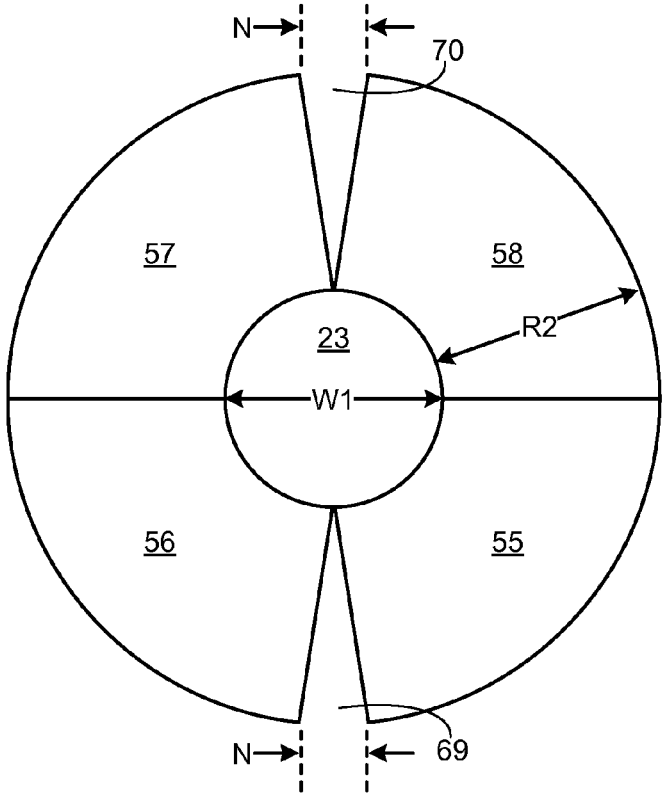
FIG. 7 is a diagram illustrating a bottom plan view of the auger of FIG. 5.

FIGS. 5-7 illustrate close-up views of an alternate embodiment of the aforementioned auger. More particularly, FIG. 5 illustrates a close-up, longitudinal, transparent plan view of an alternate embodiment of the auger. FIG. 6 illustrates a transparent plan view of the auger of FIG. 5 rotated counterclockwise 90 degrees about its longitudinal axis. FIG. 7 illustrates a bottom plan view of the auger of FIG. 5. Generally speaking and as exemplified in FIGS. 5-7, the auger 28 includes a plurality of fin pairs 39/40, 41/42, 43/44, 45/46, 47/48, 49/50, 51/52, 53/54, 55/56 and 57/58 which are rigidly disposed on the exterior surface of the first shaft 19. Each fin pair includes a leading fin (40, 42, 44, 46, 48, 50, 52, 54, 56 and 58) and a trailing fin (39, 41, 43, 45, 47, 49, 51, 53, 55 and 57). Each leading fin (such as fin 58 and the like) is planar, extends radially outward from the exterior surface of the first shaft 19, and is substantially rigid and thus substantially non-pliable. Each trailing fin (such as fin 57 and the like) is also planar, also extends radially outward from the exterior surface of the first shaft 19, and is also substantially rigid and thus substantially non-pliable. The leading and trailing fins in each fin pair reside on a common plane as exemplified in FIG. 5.

Referring again to FIGS. 5-7, the fin pairs (such as fin pair 39/40 and the like) are sequentially arranged along the exterior surface of the first shaft 19, starting at the distal end of the first shaft 23, such that the sequential arrangement thereof forms a helix along the longitudinal axis Z of the first shaft. Generally speaking and as is appreciated in the art of mathematics, the helix formed by the fin pairs can be either a left-handed helix or a right-handed helix. More particularly, in the drain snake embodiment exemplified in FIGS. 5 and 6 the fin pairs form a left-handed helix (i.e., a helix where a clockwise screwing motion around the longitudinal axis Z moves the helix toward the distal end of the first shaft). An alternate drain snake embodiment (not shown) is also possible where the fin pairs form a right-handed helix (i.e., a helix where a clockwise screwing motion around the longitudinal axis Z moves the helix toward the proximal end of the first shaft 22). In the drain snake embodiment exemplified in FIGS. 5 and 6 the auger 28 includes ten fin pairs (i.e. the auger include ten leading fins (such as such as fin 58 and the like) and ten trailing fins (such as fin 57 and the like)). Alternate drain snake embodiments (not shown) are also possible where the number of fin pairs is either less than ten or greater than ten.

Referring again to FIGS. 5-7, each fin pair (such as fin pair 57/58 and the like) has a semicircular shape, with the leading fin in each pair (such as fin 58 and the like) residing in one quadrant of the semicircle and the trailing fin in each pair (such as fin 57 and the like) residing in the other quadrant of the semicircle. The leading and trailing fins in each find pair are separated by a small notch 61-70 having a prescribed size N.

Referring again to FIGS. 5-7, the leading fin in each fin pair (such as fin 58 and the like) is oriented at a prescribed angle A1 to the longitudinal axis Z of the first shaft 19, where angle A1 is acute and has a vertex V1 which points away from the proximal end of the first shaft. The trailing fin in each fin pair (such as fin 57 and the like) is oriented at a prescribed angle A2 to the longitudinal axis Z of the first shaft, where angle A2 has the same value as angle A1 and has a vertex V2 which points toward the proximal end of the first shaft. The leading fin in each fin pair extends a prescribed radial distance R2 from the exterior surface of the first shaft. The trailing fin in each fin pair extends the same radial distance R2 from the exterior surface of the first shaft. As is appreciated in the art of mathematics, the pitch of a helix is the width of one complete turn of the helix around its axis, measured parallel to the axis. It will thus be appreciated that particular values for angle A1 (and thus A2) and distance R2 result in the fin pairs (such as fin pair 57/58 and the like) forming a helix having a particular pitch P. The leading fin in each fin pair has a prescribed thickness Y1 and the trailing fin in each fin pair has a prescribed thickness Y2, where Y1 and Y2 can have either the same value, or different values.

Generally speaking and referring again to FIGS. 1 and 5-7, fin thicknesses Y1 and Y2, notch size N, radial distance R2, and angles A1 and A2 can have a variety of values, and these values are independently set according to the needs of one or more types of water containers 12 and their associated drain systems that the drain snake 15 is intended to be used on. The following considerations exist when selecting the particular values that are used for thicknesses Y1 and Y2, notch size N, distance R2, and angles A1 and A2. Thicknesses Y1 and Y2 are generally set to values which are as small as possible while still resulting in fin pairs (such as fin pair 57/58 and the like) which are substantially rigid and non-pliable. Setting thicknesses Y1 and Y2 to overly small values can result in fin pairs which can break off the drain snake when it is used to unclog 18 from a drain system 11. On the other hand, setting thicknesses Y1 and Y2 to overly large values can reduce each fin pair's effectiveness as a boring device, and reduces the auger's 28 effectiveness as a scraping device, a pick-up device and a clog-removal device. Setting thicknesses Y1 and Y2 to overly large values can also result in a larger amount of material being consumed to construct the drain snake. Notch size N is generally set to a value which is small enough to maintain each fin pair's effectiveness as a scraping device and a boring device, while still allowing each fin pair to operate as an effective a pick-up device and a clog-removal device. Setting notch size N to an overly small value can reduce each fin pair's effectiveness as a pick-up device and a clog-removal device. On the other hand, setting notch size N to an overly large value can reduce each fin pair's effectiveness as a scraping device and a boring device. Distance R2 is generally set to a value which is as large as possible while still allowing the auger to slide freely through the annular peripheral drainage gap G between the drain-stopper 14 and the drain opening 13, and also still allowing the auger to travel through the drainpipe 16 to the location of the clog. Setting distance R2 to an overly small value can reduce each fin pair's effectiveness as a scraping device, a boring device, a pick-up device and a clog-removal device. For a given distance R2, decreasing the value of angle A1 generally increases the pitch P of the helix formed by the fin pairs and thus decreases the number of fin pairs appearing in a given distance along the longitudinal axis Z of the first shaft 19. In the aforementioned exemplary embodiment of the drain snake where the first shaft has a width W1 of four millimeters, notch size N can have a value of 1.5 millimeters, angle A1 (and thus A2) can have a value of 57.5 degrees, distance R2 can have a value of three millimeters, thickness Y1 can have a value of one millimeter, and thickness Y2 can have a value of one millimeter.

Generally speaking and referring again to FIGS. 5 and 6, the fin pairs (such as fin pair 57/58 and the like) can be constructed from the same material(s) as the rest of the drain snake. More particularly, in the aforementioned drain snake embodiment where the drain snake is constructed from a homogeneous material, the fin pairs can be constructed from this same homogeneous material. In the aforementioned drain snake embodiment where the drain snake is constructed from an outer layer of a first material that is disposed over an inner core of a second material, the fin pairs can be constructed in a similar manner.

1.3 Drain Snake Operation

Figure 8:
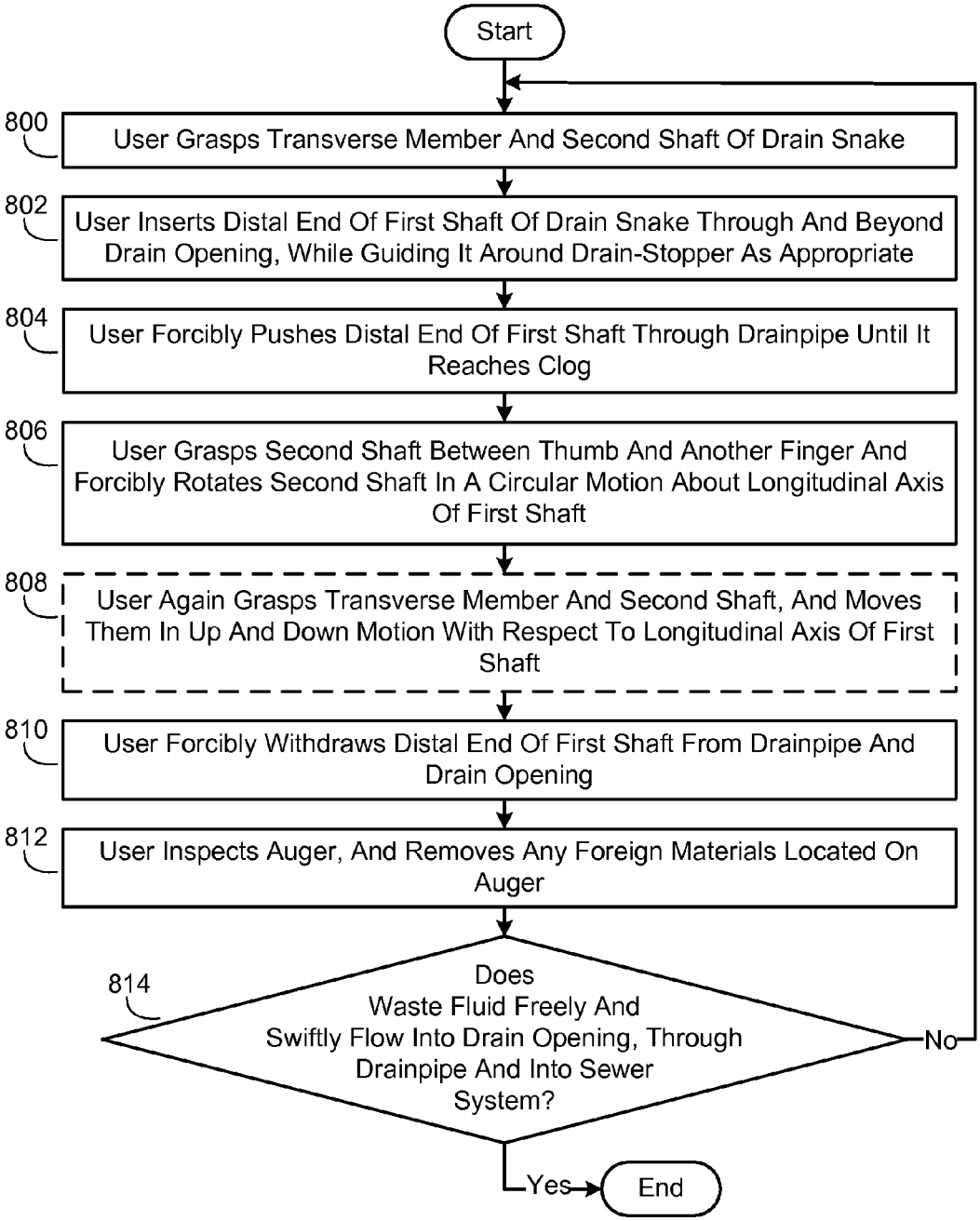
FIG. 8 is a flow diagram illustrating an exemplary embodiment of a process for using the drain snake embodiments to unclog a drain system which has become clogged.

FIG. 8 illustrates an exemplary embodiment of a process for using the drain snake embodiments described herein to unclog a drain system which has become clogged with one or more foreign materials as described heretofore. As exemplified in FIG. 8, the process starts in block 800 with a user (herein also referred to as "an individual") grasping the transverse member and second shaft of the drain snake. In the aforementioned drain snake embodiment where the transverse member includes an interior opening, the user may grasp the drain snake by first inserting a finger (such as an index finger and the like) through the opening and then using their other fingers to clasp the transverse member and second shaft in the palm of their hand. In the aforementioned alternate drain snake embodiment where the transverse member does not have an interior opening, the user may grasp the drain snake by simply clasping the transverse member and second shaft in the palm of their hand.

Referring again to FIG. 8, after the user grasps the transverse member and second shaft of the drain snake (block 800), they then insert the distal end of the first shaft of the drain snake through and beyond the drain opening, while guiding the distal end around the drain-stopper as appropriate if one is included in the drain opening (block 802). The user then forcibly pushes the distal end of the first shaft through the drainpipe until it reaches the clog (block 804). The aforementioned flexibility of the first shaft allows it to follow the curvature of the water trap and any other bends which may exist in the drainpipe. Foreign materials that are deposited on the surface of the drain-stopper and the interior wall of the drainpipe will be dislodged (i.e., scraped off) as the auger on the distal end of the first shaft comes in contact with the foreign materials.

Referring again to FIG. 8, once the distal end of the drain snake reaches the clog (block 804), the user grasps the second shaft between a thumb and another finger (such as an index finger and the like) and forcibly rotates the second shaft in a circular motion about the longitudinal axis of the first shaft (block 806). This rotation of the second shaft serves to rotate the auger through the clog, thus breaking up and dislodging the clog, snagging and entangling the foreign materials that make up the clog on the barbs or fins of the auger, and causing these materials to be progressively wound onto the auger and pulled away from the interior wall of the drainpipe. Then, the user can optionally again grasp the transverse member and second shaft and move them in an up and down motion with respect to the longitudinal axis of the first shaft, thus agitating the auger within the clog (block 808). This agitation of the auger within the clog serves to further break up and dislodge the clog, and further snag and entangle the foreign materials that make up the clog on the barbs or fins of the auger. The user then forcibly withdraws the distal end of the first shaft from the drainpipe and drain opening (block 810). Foreign materials that still exist on the interior wall of the drainpipe will be scraped off as the auger comes in contact with these foreign materials. Foreign materials which are entangled on the barbs or fins of the auger will be dragged out of the drain system. The user then inspects the auger, and removes any foreign materials that are located on the auger (block 812). The user can then repeat the actions of blocks 800 through 812 as necessary until the waste fluid freely and swiftly flows into the drain opening, through the drainpipe and into the sewer system (block 814).

2.0 Additional Embodiments

While the drain snake has been described by specific reference to embodiments thereof, it is understood that variations and modifications thereof can be made without departing from the true spirit and scope of the drain snake. By way of example but not limitation, an alternate embodiment of the drain snake is possible which does not include the aforementioned second shaft or finger retention member.

It is also noted that any or all of the aforementioned embodiments can be used in any combination desired to form additional hybrid embodiments. Although the drain snake embodiments have been described in language specific to structural features and/or methodological acts, it is to be understood that the subject matter defined in the appended claims is not necessarily limited to the specific features or acts described heretofore. Rather, the specific features and acts described heretofore are disclosed as example forms of implementing the claims.

Wherefore, what is claimed is:

1. A hand-operated drain snake, comprising:

a first shaft comprising a first longitudinal axis, a length L1 and a width W1;

an auger disposed on a radially exterior surface of the first shaft, the auger extending radially outward from the first shaft;

a second shaft comprising a second longitudinal axis, a length L2 and a width W2; and a transverse member, comprising an interior opening having a central longitudinal axis that passes between the first and second longitudinal axes and extends out of the plane of the first and second longitudinal axes, wherein, a proximal end of the first shaft is disposed on one side of the transverse member and a proximal end of the second shaft is disposed on an opposite side of the transverse member such that the first longitudinal axis is substantially parallel to the second longitudinal axis, and the first longitudinal axis is offset from the second longitudinal axis by an offset distance X.

2. The drain snake of claim 1, wherein either:

a distal end of the first shaft comprises one of, a semi-spherical shape, or a conical shape, or a wedge shape; or said distal end is planar.

3. The drain snake of claim 1, wherein the transverse member comprises an exterior shape comprising one of:

a circular shape; or an oval shape; or a square shape; or a rectangular shape; or an hexagonal shape.

4. The drain snake of claim 1, wherein the transverse member comprises:

an exterior shape; and the interior opening comprising a diameter D1 and an interior shape, said opening being oriented along the central axis that passes between the first longitudinal axis and the second longitudinal axis, wherein, said exterior shape is the same as said interior shape.

5. The drain snake of claim 4, wherein, length L1 is 22 inches, length L2 is one inch, width W1 and width W2 are both four millimeters, offset distance X is one inch, and diameter D1 is 13/16 of an inch.

6. The drain snake of claim 1, wherein the transverse member comprises:

an exterior shape; and the interior opening comprising a diameter D1 and an interior shape, said opening allowing a user to grasp the drain snake by inserting a finger through said opening, wherein, said exterior shape is different than said interior shape.

7. The drain snake of claim 1, further comprising a finger retention member which is disposed on a distal end of the second shaft, wherein said member comprises a diameter D2 which is greater than width W2.

8. The drain snake of claim 7, wherein the finger retention member further comprises an exterior shape comprising one of:

a spherical shape; or a pentagonal icositetrahedron shape; or a pentagonal hexecontahedron shape.

9. The drain snake of claim 1, wherein:

the first shaft further comprises a first radial cross-sectional shape comprising one of, a circular shape, or an oval shape, or a square shape, or a rectangular shape, or an hexagonal shape, or an octagonal shape;

the second shaft further comprises a second radial cross-sectional shape comprising one of, a circular shape, or an oval shape, or a square shape, or a rectangular shape, or an hexagonal shape, or an octagonal shape; and the first radial cross-sectional shape is the same as the second radial cross-sectional shape.

10. The drain snake of claim 1, wherein:

the first shaft further comprises a first radial cross-sectional shape comprising one of, a circular shape, or an oval shape, or a square shape, or a rectangular shape, or an hexagonal shape, or an octagonal shape;

the second shaft further comprises a second radial cross-sectional shape comprising one of, a circular shape, or an oval shape, or a square shape, or a rectangular shape, or an hexagonal shape, or an octagonal shape; and the first radial cross-sectional shape is different than the second radial cross-sectional shape.

11. The drain snake of claim 1, wherein either:

the first shaft, auger, second shaft and transverse member are constructed from a material that is durable and resiliently flexible, said material comprising one of a synthetic resin or an elastomer; or the first shaft, auger, second shaft and transverse member are constructed from a combination of different materials, wherein said combination is durable and resiliently flexible, and comprises an elastomeric core over which a polytetrafluoroethylene layer is disposed.

12. The drain snake of claim 1, wherein, the auger comprises a plurality of barbs, each barb is disposed on the exterior surface of the first shaft and comprises a longitudinal height H, each barb is shaped in the form of a hook which tapers radially outward and longitudinally upward to a tip which points toward the proximal end of the first shaft, each barb extends a radial distance R1 from said exterior surface, and the barbs are sequentially arranged along said exterior surface starting at a distal end of the first shaft such that the barbs are radially oriented along a common plane that is centered along the first longitudinal axis.

13. The drain snake of claim 12, wherein each barb is substantially rigid and non-pliable.

14. The drain snake of claim 12, wherein,
the auger comprises eleven barbs,
width W1 is four millimeters,
height H is seven millimeters, and
distance R1 is three millimeters.

15. The drain snake of claim 12, wherein either,
successive barbs in the sequential arrangement are disposed on radially opposite sides of the first shaft, or
successive barbs in the sequential arrangement are disposed on a common radial side of the first shaft.

16. The drain snake of claim 12, wherein either,
the tip of each barb in the sequential arrangement is aligned along the first longitudinal axis with a bottom of the next barb in said arrangement, or
the tip of each barb in said arrangement longitudinally overlaps the next barb in said arrangement, or
the tip of each barb in said arrangement is separated along the first longitudinal axis from the bottom of the next barb in said arrangement by a prescribed distance.

17. The drain snake of claim 1, wherein,
the auger comprises a plurality of fin pairs which are sequentially arranged along the exterior surface of the first shaft starting at a distal end of the first shaft such that said arrangement forms a helix along the first longitudinal axis,
each fin pair is disposed on said exterior surface and comprises a semicircular shape,
each fin pair further comprises a leading fin, wherein each leading fin is planar, extends radially outward a distance R2 from said exterior surface, resides in a first quadrant of said shape, comprises a thickness Y1, and is oriented at an angle A1 to the first longitudinal axis, said angle A1 being acute and having a vertex which points away from the proximal end of the first shaft,
each fin pair further comprises a trailing fin, wherein each trailing fin is planar, extends radially outward the distance R2 from said exterior surface, resides in a second quadrant of said shape, comprises a thickness Y2, and is oriented at an angle A2 to the first longitudinal axis, said angle A2 having the same value as angle A1 and a vertex which points toward the proximal end of the first shaft, and
the leading and trailing fins in each fin pair reside on a common plane and are separated by a notch comprising a size N.

18. The drain snake of claim 17, wherein the helix comprises one of:
a left-handed helix; or
a right-handed helix.

19. The drain snake of claim 17, wherein,
the auger comprises ten fin pairs,
width W1 is four millimeters,
notch size N is 1.5 millimeters,
angle A1 is 57.5 degrees,
thickness Y1 is one millimeter,
thickness Y2 is one millimeter, and
distance R2 is three millimeters.

20. A drain snake for unclogging a drain system which has become clogged with one or more foreign materials, comprising:
an augering means for dislodging any foreign materials that are deposited on an interior wall of a drainpipe of the drain system as the augering means is pushed through the drainpipe, and for boring through the clog as the augering means is rotated, and for snagging and entangling the foreign materials that make up the clog, and winding said materials onto the augering means, as the augering means is rotated, and for dragging said materials out of the drain system as the augering means is withdrawn from the drainpipe;
a cranking means for rotating the augering means; and
an interconnecting means for rigidly attaching the augering means to the cranking means such that a longitudinal axis of the augering means is substantially parallel to a longitudinal axis of the cranking means.

21. A hand-operated drain snake, comprising:
a first shaft comprising a first longitudinal axis;
an auger comprising a plurality of barbs, wherein,
each barb is disposed on an exterior surface of the first shaft,
each barb is shaped in the form of a hook which tapers radially outward and longitudinally upward to a tip which points toward a proximal end of the first shaft, and
the barbs are sequentially arranged along said exterior surface starting at a distal end of the first shaft such that,
the barbs are radially oriented along a common plane that is centered along the first longitudinal axis,
successive barbs in the sequential arrangement are disposed on radially opposite sides of the first shaft, and
the tip of each barb in said arrangement is aligned along the first longitudinal axis with a bottom of the next barb in said arrangement;
a second shaft comprising a second longitudinal axis; and
a transverse member comprising an interior opening which is oriented along a central axis that passes between the first longitudinal axis and the second longitudinal axis, wherein,
the proximal end of the first shaft is disposed on one side of the transverse member and a proximal end of the second shaft is disposed on an opposite side of the transverse member such that the first longitudinal axis is substantially parallel to the second longitudinal axis, the central axis extends perpendicular out of the plane of the first and second longitudinal axes, and
the first shaft, auger, second shaft and transverse member are constructed from a material that is durable and resiliently flexible.

* * * * *